US009803960B2

(12) United States Patent
Banducci et al.

(10) Patent No.: US 9,803,960 B2
(45) Date of Patent: Oct. 31, 2017

(54) FULL BALLISTIC SHIELDS

(71) Applicants: Paul J. Banducci, Traverse City, MI (US); Allen F. Hudson, Whitchurch (GB)

(72) Inventors: Paul J. Banducci, Traverse City, MI (US); Allen F. Hudson, Whitchurch (GB)

( * ) Notice: Subject to any disclaimer, the term of this patent is extended or adjusted under 35 U.S.C. 154(b) by 0 days.

(21) Appl. No.: 15/153,761

(22) Filed: May 13, 2016

(65) Prior Publication Data

US 2017/0023334 A1 Jan. 26, 2017

Related U.S. Application Data

(60) Provisional application No. 62/196,632, filed on Jul. 24, 2015.

(51) Int. Cl.
*F41H 5/08* (2006.01)
*F41H 5/04* (2006.01)

(52) U.S. Cl.
CPC ..... *F41H 5/08* (2013.01); *F41H 5/0407* (2013.01); *F41H 5/0485* (2013.01)

(58) Field of Classification Search
CPC ..... F41H 5/08; F41H 5/0485; F41H 5/0407
USPC ..... 89/36.02, 36.07, 36.05
See application file for complete search history.

(56) References Cited

U.S. PATENT DOCUMENTS 1,279,571 A * 9/1918 Moloney ..... F41H 5/08 109/58.5
2,316,055 A * 4/1943 Davey ..... F41H 5/08 2/2.5
3,370,302 A * 2/1968 Karlyn ..... F41H 5/08 128/846
4,674,394 A * 6/1987 Martino ..... F41H 5/08 109/49.5
4,843,947 A * 7/1989 Bauer ..... F41H 5/08 109/49.5
5,056,155 A * 10/1991 Truxell ..... F41H 5/08 109/49.5
5,241,703 A * 9/1993 Roberts ..... F41H 5/08 109/49.5
5,619,748 A * 4/1997 Nelson ..... F41H 5/0478 2/2.5
6,000,347 A * 12/1999 Madden, Jr. ..... A45C 9/00 109/22
6,170,379 B1 1/2001 Taylor
6,367,943 B1 * 4/2002 Tocci ..... F41H 5/08 362/103
6,691,601 B2 2/2004 Cohen et al.
7,124,675 B1 10/2006 Sand
7,302,880 B1 * 12/2007 Elasic ..... F41H 13/0087 89/36.01
7,520,206 B2 * 4/2009 Baker ..... F41H 5/08 89/36.05
7,716,748 B2 5/2010 Dovner (Continued)

*Primary Examiner* — Joshua Freeman
(74) *Attorney, Agent, or Firm* — McKellar IP Law, PLLC

(57) ABSTRACT

A full ballistic shield that can be carried by hand by an individual to protect that individual from bullets and the like in both the bottom portion of the body and the upper portion of the body, including the head and shoulders. The upper portion of the shield is a clear, unframed plastic plate that enhances the field of view of the user and provides extra protection.

1 Claim, 2 Drawing Sheets

(56) References Cited

U.S. PATENT DOCUMENTS 8,276,498 B1* 10/2012 Hannibal ..... F41H 5/08 89/36.05
8,356,540 B2 1/2013 Priebe et al.
8,584,571 B2 11/2013 Armellino
9,267,764 B2* 2/2016 Seabrook ..... F41H 5/08
2005/0217472 A1* 10/2005 Baker ..... F41H 5/08 89/36.06
2007/0125224 A1* 6/2007 Thomas ..... F41H 5/08 89/36.07
2007/0149051 A1* 6/2007 Prock ..... F41H 3/00 439/607.01
2007/0283477 A1* 12/2007 Dovner ..... F41C 33/0209 2/2.5
2010/0083820 A1* 4/2010 Doyner ..... F41H 5/08 89/36.02
2011/0005380 A1* 1/2011 Hogan ..... F41H 5/08 89/36.02
2011/0226123 A1* 9/2011 Priebe ..... F41H 5/08 89/36.02
2012/0006453 A1* 1/2012 Clayton ..... F41H 5/08 150/154
2012/0051572 A1* 3/2012 Graber ..... F41H 5/08 381/334
2012/0152096 A1* 6/2012 Peters ..... F41H 5/06 89/36.01
2012/0180636 A1* 7/2012 Seuk ..... F41H 5/08 89/36.07
2013/0098234 A1* 4/2013 Armellino, Jr. ..... F41H 5/08 89/36.05
2013/0205983 A1* 8/2013 Martin ..... F41H 5/013 89/36.07
2014/0165270 A1* 6/2014 Gaynor ..... F41H 5/08 2/455
2014/0224109 A1* 8/2014 Chandler ..... F41H 5/08 89/36.07
2014/0233235 A1* 8/2014 Micarelli ..... F41H 5/08 362/253
2014/0238225 A1* 8/2014 Mickiewicz ..... F41H 5/26 89/36.07
2015/0047940 A1* 2/2015 Casas ..... A45C 13/36 190/127
2015/0233679 A1* 8/2015 Seabrook ..... F41H 5/08 89/36.07
2015/0323288 A1* 11/2015 Von Hess ..... F41H 5/0485 428/219
2016/0029713 A1* 2/2016 Bishop ..... A41D 13/05 2/2.5
2016/0054101 A1* 2/2016 Rashad ..... A01K 29/00 109/23
2016/0289891 A1* 10/2016 Bader ..... D06N 3/0034
2016/0290770 A1* 10/2016 Martinez ..... F41H 5/08

* cited by examiner

FULL BALLISTIC SHIELDS

This application is a U.S. utility application claiming priority from U.S. provisional patent application Ser. No. 62/196,632, filed Jul. 24, 2016.

BACKGROUND OF THE INVENTION

The present invention deals with a full ballistic shield that can be carried by hand by an individual to protect that individual from bullets and the like in both the bottom portion of the body and the upper portion of the body, including the head and shoulders. The upper portion of the shield is a clear, unframed plastic plate that enhances the field of view of the user and provides ballistic protection.

Ballistic protection apparati, such as ballistic shields, are used for a variety of different applications such as, for example, military personnel can use the shield in close combat with an enemy; law enforcement personnel can also use the shields for projection during tactical operations and, some non-combative personnel can use them for crowd control activities, and the like.

Many shields are made of materials that make them relatively light in weight and yet they still remain protective. Some shields allow for the ability to mount or support weapons on the shield. In addition, some shields only protect the bottom portion of the body.

Another shield is a riot or capture shield having high intensity light arrays attached to it which can be found in U.S. Pat. No. 6,367,943, that issued Apr. 9, 2002 to Tocci, et al.

Yet another apparatus is a riot shield that is disclosed in U.S. Pat. No. 4,843,947 that issued to Eran Bauer, et al on Jul. 4, 1989 which can be linked with a like apparatus to give a larger shield.

All of the aforementioned shields are not ballistic shields, that is, they are not protective against bullets.

Ballistic shields can be found in U.S. Pat. No. 6,691,601, that issued Feb. 17, 2004 to Avi Cohen, et al. The shield provides a central panel and two wing panels wherein the wing panels swing in behind the central panel to provide added protection.

A further disclosure can be found in U.S. Pat. No. 8,356,540, that issued on Jan. 22, 2013 to Preibe, et al in which there is shown an apparatus which provides advanced protection for first incident responders.

Another ballistic shield is provided in U.S. Pat. No. 8,584,571, which issued Nov. 19, 2013 to Armellino in which there are two panels, a lower panel and an upper panel. The upper panel is larger than the lower panel and the upper panel has an opening for weapons to be used, it being alleged that the use of such a panel cuts down on the movement of the entire shield curing the firing of a weapon.

The patentee states that the shield can be prepared from chemically reinforced layers of structural reinforcing fibers such as aramid, polyethylene, and/or fiberglass. The patentee also states that the shield portion 10 can also be made from other materials such as hard plastic or a metal such as iron or steel.

U.S. Pat. No. 7,124,675 that issued Oct. 24, 2006 to Sand, deals with a portable ballistic shield and shooting platform. Thus, it does not deal with a personal, portable shield.

U.S. Pat. No. 7,716,748 that issued May 18, 2010 to Dovner deals with a protective shield having an upper portion and a lower portion. The upper portion carries a view port which is limited in size as opposed to the device of the instant invention which gives a much more open view and non-obstruction of the field of view.

Shields, in general, are fairly popular and are used for a variety at end use applications. One such shield can be found in U.S. Pat. No. 6,170,379, issued on Jan. 9, 2001 to Taylor in which there is disclosed a releasable bullet resistant desk top for use in schools and the like.

THE INVENTION

What is disclosed and claimed herein is a full body ballistic shield. The ballistic shield comprises an opaque lower portion having a predetermined size. The lower portion is comprised of a high strength ballistic fiber having a ballistic protection of NIJ IIIA, and the lower portion further comprises a back, a top, and an outside edge.

The back has fixedly attached to it, a handle system. The handle system is comprised of a singular mounting plate having mounted to it, adjustable straps, and in addition, the mounting plate has three hand grips fixedly attached to it. The edge is covered with a capping channel. The upper portion is surmounted near the top of the lower portion and the upper portion is a clear ballistic panel smaller than the lower portion. The panel has a ballistic protection level at NIJ IIIA.

DETAILED DESCRIPTION OF THE INVENTION

Figure 1:
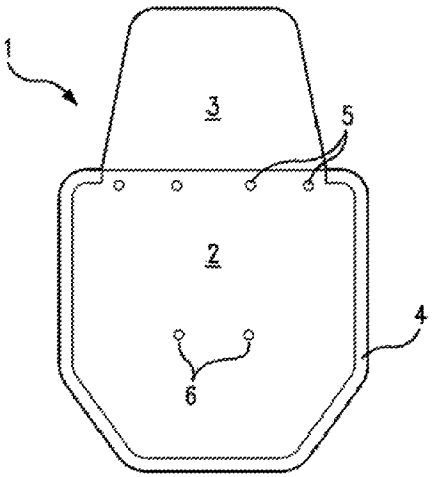
FIG. 1 is a full front view of a device of this invention.

Shown in FIG. 1 is a full front view of a device 1 of this invention. Shown is an upper portion 3 with a lower portion 2. Also shown are the fasteners 5 for attaching the upper portion 3 to the lower portion 2 and the fasteners 6 for attaching a metal plate 9 to the back of the lower portion 2. Finally, there is shown the edge, channeling 4 that covers the outer edge of the lower portion 2.

Figure 2:
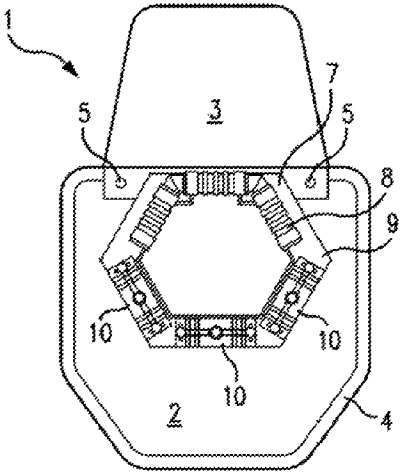
FIG. 2 is a full back view of a device of this invention.

Regarding FIG. 2, there is shown a device 1 of this invention also showing an upper portion 3, a lower portion 2, channeling 4, fasteners 5 and metal plate 9.

Shown in FIG. 2 is one example of the ergonomic grip handles 7, covered with soft foam, felt or something of that nature 8, to cushion the grips.

Shown in this example are the ergonomic grip handles 7 that are attached no the lower portion 2 onto the metal plate 9. It should be noted that in this example, there are three handles such that a wide variety of alternate hand grips can be attained so as to rest and relax the hands of the user and provide comfort to the user.

Figure 6:
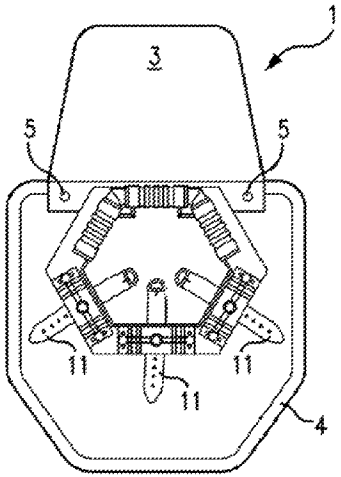
FIG. 6 is a full back view of a device of this invention showing a strap arrangement.

Mounted on the metal plate 9, just below the grips 7 are a plurality of plates 10 that are used to contain belts 11. Such belts 11 can be observed in FIG. 6. These belts 11 are provided so that the user can attach the shield 1 to an arm to help support the shield.

Figure 3:
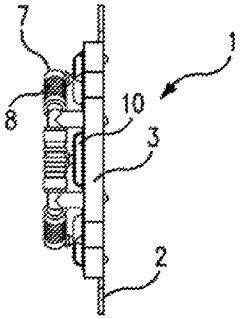
FIG. 3 is a full top view of a device of this invention.
Figure 4:
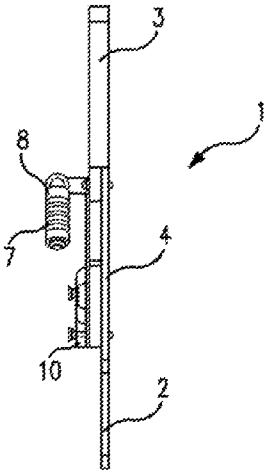
FIG. 4 is a full edge view of a device of this invention.

FIG. 3 is a full top view of the device 1 of this invention wherein like number designations are like components as shown in FIGS. 1 and 2, while FIG. 4 is a full edge view of the device 1 of this invention, also wherein like number designations mean like components as shown in FIGS. 1 and 2.

Figure 5:
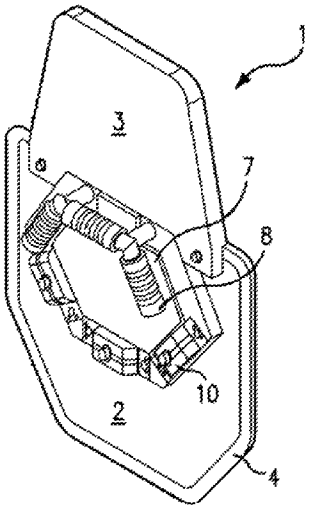
FIG. 5 is a full view in perspective, showing the back of a device of this invention.

FIG. 5 is a full view in perspective of the back of a device 1 in order to more clearly see the arrangement of components and their relationship to each other, wherein like number designations mean like components as described in FIGS. 1 and 2.

Figure 7:
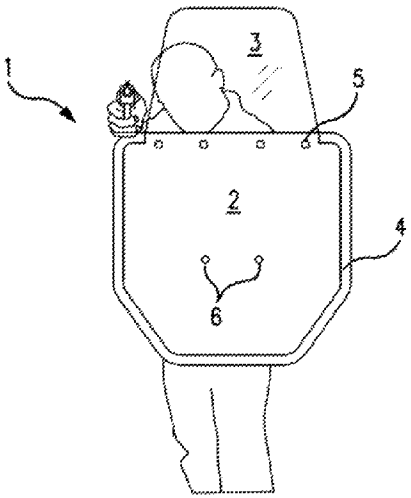
FIG. 7 is a full front view of a device of this invention being used by personnel using a weapon.

Finally, FIG. 7 is a full front view of a device 1 of this invention wherein a user is standing behind the device 1 and holding the device 1 and using a weapon. This Figure is included to give one skilled in the art the relative size of the upper and lower portions and the overall size of the device 1.

The grips 7 are manufactured from metal or tough plastic and covered with a cushioning material as set forth Supra. The belt holders 10 are also manufactured from metal or tough plastic and are capable of holding the belts 11 in a predetermined position.

The lower portion 2 can be manufactured from Aramid fibers or an ultra-high Molecular weight polyethylene, or other high strength material used in ballistic protection, which can be either woven or laminated in layered sheets, such as, but not limited to a "0° to 90°" manner, i.e. layered fibers and or sheets alternating horizontally and vertically, or some other non-homogeneous layering, and combining multiple layers with either a thermoset resin (adhesive) which impregnates the fibers, or a thermoplastic film resin between the layers, which produces a rigid shield, which provides the ballistic protection. The ballistic protection provides an NIJ Level IIIA threat protection (NIJ=National Institute of Justice that publishes standards for the testing and certification of ballistic materials).

A level IIIA shield provides protection from most handguns, such as, 9 mm, 44 magnum, and 357 sig, and lesser threats. This threat protection is the industry standard for ballistic protection shields which police and military use to protect them from being shot. This is a material difference from a non-ballistic "riot shield" which protects the user only from being hit by rocks/bottles, and the like. The edge of the shield is fitted with, for example, a neoprene channel which protects the ballistic panel.

The shield upper portion is manufactured from a laminated solution combining polycarbonate and acrylic layers. By having this size of viewing area, it offers the operator a much wider viewing area and self-protection over a wider portion of the body. The upper portion may have tear off strips applied to the front and back of the panel to help prevent scratching of the panel face in the day to day operations.

The handle system is unique and has been ergonomically designed. The handle system is made up of an approximately 3 mm aluminum mounting plate which has three forearm straps which can be adjusted around the arm of the user. The straps are fixed to the aluminum base by base plates using rivets, or the like. The hand grip is made from plastic or metal, such as aluminum tubing and is fixed to the base plate by bolts and nuts. The hand grips are covered with foam, or the like, soft material to offer better grip. Both the base plate and the hand grip can be finished in black powder coating. The base plate has a 12 mm foam pad comfort pad.

The upper panel and the handle system are bolted using bolts and nuts. Due to the thickness of the panel, there is a spacer underneath the metal base plate to keep it level. Once the shield has been assembled, all of the bolt and nuts have cover caps fitted over them.

What is claimed is:

1. A full body ballistic shield comprising an opaque lower portion having a predetermined size, said lower portion being comprised of high strength ballistic fibers having a ballistic protection of NIJ IIIA, said lower portion further comprising a back, a top, and an outside edge; said outside edge being covered with a capping channel said back having fixedly attached thereto a singular metal mounting plate; the metal mounting plate having attached thereto at least one ergonomic grip handle and a plurality of plates attached below the grip handle each plate having mounted thereon an adjustable strap, an upper portion surmounted near said top, said upper portion being a clear ballistic window smaller than said lower portion; said ballistic window having a ballistic protection at level NIJ IIIA.

* * * * *